US009864291B1

(12) United States Patent
Veregin et al.

(10) Patent No.: US 9,864,291 B1
(45) Date of Patent: Jan. 9, 2018

(54) TONER COMPOSITIONS COMPRISING CRYSTALLINE POLYESTER AND WAX

(71) Applicant: XEROX CORPORATION, Norwalk, CT (US)

(72) Inventors: Richard P. N. Veregin, Ontario (CA); Valerie M. Farrugia, Oakville (CA); Frank Ping-Hay Lee, Oakville (CA); Michael J. D'Amato, Thornhill (CA); Michael S. Hawkins, Cambridge (CA); Edward G. Zwartz, Mississauga (CA); Yulin Wang, Oakville (CA); Abdisamed Sheik-Qasim, Etobicoke (CA); Sandra J. Gardner, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/187,475

(22) Filed: Jun. 20, 2016

(51) Int. Cl.
*G03G 9/097* (2006.01)
*G03G 9/093* (2006.01)
*G03G 9/08* (2006.01)

(52) U.S. Cl.
CPC ..... *G03G 9/09371* (2013.01); *G03G 9/0821* (2013.01); *G03G 9/09321* (2013.01)

(58) Field of Classification Search
CPC ..... G03G 9/08708; G03G 9/08711; G03G 9/08755; G03G 9/08782; G03G 9/09321
See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 4,298,672 | A | 11/1981 | Lu | |
| 4,338,390 | A | 7/1982 | Lu | |
| 6,214,507 | B1 | 4/2001 | Sokol et al. | |
| 8,691,488 | B2 | 4/2014 | Davis et al. | |
| 2008/0081912 | A1 | 4/2008 | Harada et al. | |
| 2008/0261141 | A1 | 10/2008 | Yasukawa et al. | |
| 2011/0183252 | A1 * | 7/2011 | Pang | G03G 9/0819 430/109.4 |
| 2011/0236812 | A1 * | 9/2011 | Ishihara | G03G 9/0819 430/105 |
| 2012/0231385 | A1 | 9/2012 | Tamaki et al. | |
| 2015/0118613 | A1 * | 4/2015 | Nosella | G03G 9/08711 430/109.3 |

FOREIGN PATENT DOCUMENTS

| | | | | |
|---|---|---|---|---|
| EP | 2 159 642 | A2 * | 3/2010 | G03G 9/08 |

* cited by examiner

*Primary Examiner* — Peter Vajda
(74) *Attorney, Agent, or Firm* — Pillsbury Winthrop Shaw Pittman LLP

(57) ABSTRACT

A hybrid toner includes a core having at least one amorphous polyester resin and at least one crystalline polyester resin, and at least one styrene/acrylate resin, a shell comprising at least one styrene/acrylate resin, at least one wax, and optionally a pigment dispersion, the first modulated differential calorimetry scan of the hybrid toner shows at least two melting point peaks below about 80° C., and the difference between the two melting point peaks is less than or equal to about 15° C.

19 Claims, No Drawings

TONER COMPOSITIONS COMPRISING CRYSTALLINE POLYESTER AND WAX

BACKGROUND

The present disclosure relates to relates to toners. In particular, the present disclosure relates to toner compositions comprising a crystalline polyester and a wax selected to exhibit improved wide fusing latitude.

Hybrid toners typically employ some combination of an amorphous polyester latex, a crystalline polyester latex, and a styrene/acrylate polymer latex. They also typically comprise a shell of styrene/acrylate polymer latex. The introduction of styrene/acrylate into the otherwise polyester-based toner composition serves to reduce overall toner costs. However, it has been observed that the fusing latitude can be insufficient, with the fusing step producing image mottle and a low hot offset temperature, especially at lower wax loadings. The present disclosure addresses this fusing latitude problem by providing a combination of a crystalline polyester and wax that performs better in the fusing process. In addition, in these hybrid toners the carbon black does not disperse well into the styrene/acrylate resin portion in the presence of the polyester, or it preferentially ends up at the interfaces of the styrene/acrylate and polyester. This poor dispersion leads to high dielectric loss, which in turn results in poor transfer efficiency in the printer and in some cases lower charge as well. The present disclosure addresses this dispersion problem thereby providing a means for ameliorating hybrid toner dielectric loss.

SUMMARY

In some aspects, embodiments herein relate to hybrid toners comprising a core comprising at least one amorphous polyester resin and at least one crystalline polyester resin, and at least one styrene/acrylate resin, a shell comprising at least one styrene/acrylate resin, at least one wax, and optionally a pigment dispersion, wherein the first modulated differential calorimetry scan of the hybrid toner shows at least two melting point peaks below about 80° C., and wherein the difference between the two melting point peaks is less than or equal to about 15° C.

In some aspects, embodiments herein relate to hybrid toners comprising a core comprising a crystalline polyester resin, an amorphous polyester resin and a styrene/acrylate resin, a shell comprising a styrene/acrylate resin, a wax disposed within the shell, the core or both, and a pigment dispersion, wherein the difference between the wax melting point and the crystalline polyester melting point is less than or equal to about 15° C.

In some aspects, embodiments herein relate to hybrid toners comprising a core comprising a crystalline polyester resin, an amorphous polyester resin and a styrene/acrylate resin, a shell comprising a styrene/acrylate resin, a paraffin wax disposed within the shell, the core or both, and a dispersion of a carbon black pigment in a non-polymeric sulfonate surfactant, wherein a purity of the carbon black pigment is greater than about 99.5 atom percent carbon, wherein the paraffin wax is in the core, the shell, or both, the wax having a peak melting point less than about 80° C., wherein the paraffin wax has an onset of melting greater than or equal to about 50° C., wherein the crystalline polyester has a melting point less than or equal to about 80° C., wherein the difference between the paraffin wax melting point and the crystalline polyester is less than or equal to about 15° C., and wherein the styrene acrylate resin has a second onset Tg from about 50° C. to about 56° C.

DETAILED DESCRIPTION

In hybrid toners that include styrene/acrylate latex added in the core, carbon black tends to disperse preferentially in the polyester. Because there is less polyester due to the replacement with styrene/acrylate, the local concentration of the carbon black is increased, which increases the chance that carbon black particles come into contact with each other. Particle to particle contact increases the conductivity of the toner as measured by dielectric loss. Using high purity carbon black is insufficient to provide sufficiently low dielectric loss. Reducing the coalescence temperature (see U.S. Pat. No. 8,691,488) is known to reduce dielectric loss in polyester toners (but not compositions incorporating styrene-acrylate) even with very high loadings of carbon black, such as in hyperpigmented toners. In the case of hybrid toners, lowering coalescence temperature makes it difficult to fully coalesce the styrene/acrylate shell. Moreover, the fuser hot offset temperature leads to toner degradation due to reduced wax on the surface, particularly when the amount of wax in the toner is lowered to reduce cost.

The present disclosure provides styrene/acrylate polyester hybrid toner compositions that exhibit low dielectric loss for black toner with excellent fusing and blocking by using a wax with a peak melting point below about 80° C., but with an onset of melting greater than about 50° C., where the crystalline polyester also has a melt point less than about 80° C., and the difference between the wax peak melting point and crystalline polyester peak melting point is less than about 15° C.:

$$\text{Wax mp} - \text{CPE mp} \leq 15^\circ \text{ C.}$$

and where the styrene-acrylate resin has a $T_g$ onset of about 50° C. to about 56° C., and where a pigment dispersant is included which dispersant comprises a naphthalene sulphonic acid polymeric surfactant.

In embodiments, hybrid toners disclosed herein are hybrid emulsion/aggregation black toner compositions, wherein the toner compositions comprise (a) a shell resin comprising styrene/acrylate, and the core comprises a styrene/acrylate resin, an amorphous polyester, a crystalline polyester, and carbon black; (b) the core, the shell, or both core and shell may further comprise a wax having a peak mp less than about 80° C. and an onset of melting greater than or equal to about 50° C.; (c) the crystalline polyester has a melt point lest than or equal to about 80° C.; (d) the difference Wax mp−CPE mp≤15° C.; (e) the styrene acrylate resin has a second onset $T_g$ of from about 50° C. to about 56° C.; (f) a pigment dispersant comprised of naphthalene sulphonic acid polymeric surfactant. The resultant toner has low dielectric loss, less than 65.

In embodiments, the hybrid toners disclosed herein have two endothermic transitions measured by modulated differential scanning calorimetry (MDSC), one from a crystalline polyester and one from a wax, with peaks that differ by less than or equal to about 15° C., with the peak of each transition being less than or equal to 80° C.

In embodiments, hybrid toners disclosed herein may have a styrene acrylate content as a fraction of the total amorphous resin may be greater than or equal to about 25%, an amorphous polyester content of less than about 75% of the amorphous resin, and the crystalline polyester content of about 4% to about 20% of the total hybrid toner composition, and the core composition may comprise from about 10% to about 50% styrene/acrylate resin.

Wax

In embodiments, the wax may be a paraffin wax. Other waxes may be used within the parameters defined herein. Thus, in embodiments, a wax with appropriate melting properties may be a polymethylene wax, a polyethylene wax, or a Fischer-Tropsch wax. In embodiments, combinations of any of the foregoing waxes may be employed. A wax may be included in the core and/or shell particles of the toner. The wax can include any of the various waxes conventionally used in emulsion aggregation toner compositions. Suitable examples of waxes include polyethylene, polymethylene, polypropylene, polyethylene/amide, polyethylenetetrafluoroethylene, and polyethylenetetrafluoroethylene/amide. Other examples include, for example, polyolefin waxes, such as polyethylene waxes, including linear polyethylene waxes and branched polyethylene waxes, and polypropylene waxes, including linear polypropylene waxes and branched polypropylene waxes; paraffin waxes; Fischer-Tropsch waxes; amine waxes; silicone waxes; mercapto waxes; polyester waxes; urethane waxes; modified polyolefin waxes (e.g., a carboxylic acid-terminated polyethylene wax or a carboxylic acid-terminated polypropylene wax); amide waxes, such as aliphatic polar amide functionalized waxes; aliphatic waxes consisting of esters of hydroxylated unsaturated fatty acids; high acid waxes, such as high acid montan waxes; microcrystalline waxes, such as waxes derived from distillation of crude oil; and the like. By "high acid waxes" it is meant a wax material that has a high acid content. The waxes can be crystalline or non-crystalline, as desired. By "crystalline polymeric waxes" it is meant that a wax material contains an ordered array of polymer chains within a polymer matrix that can be characterized by a crystalline melting point transition temperature, Tm. The crystalline melting temperature is the melting temperature of the crystalline domains of a polymer sample. This is in contrast to the glass transition temperature, Tg, which characterizes the temperature at which polymer chains begin to flow for the amorphous regions within a polymer.

To incorporate the wax into the toner, it is desirable for the wax to be in the form of one or more aqueous emulsions or dispersions of solid wax in water, where the solid wax particle size is usually in the range of from about 100 to about 500 nm.

The hybrid toners may contain the wax in any amount of from, for example, about 3 to about 15% by weight of the toner, on a dry basis. For example, the toners can contain from about 5 to about 11% by weight of the wax.

In embodiments, the hybrid toners comprise carbon black which may be a very pure grade carbon black such as about greater than 99.5% carbon content. In embodiments, the carbon black pigment is dispersed in a dispersant. In embodiments, the dispersant is a sodium arylsulfonate formaldehyde condensate. In some such embodiments, the dispersant may comprise Demol SN-B (Kao Corporation) which has been disclosed as a dispersant in toner applications for yellow colorants (U.S. 2012/0231385), magenta colorants (U.S. 2008/0261141), and to disperse an IR dye in (U.S. 2008/0081912). In embodiments, the carbon black pigment dispersant may further comprise a non-polymeric sulphonate surfactant. In such embodiments, the ratio of the polymeric naphthalene sulphonate to non-poymeric sulphonate may be from about 1:3 to 3:1. In an exemplary embodiment, the non-polymeric sulphonate surfactant may be Tayca.

In embodiments, the residual aluminum (Al) level in the hybrid toner particles disclosed herein may be from about 130 ppm to about 350 ppm.

In embodiments, the coalescence temperature may be less than or equal to about 80° C. and the coalescence temperature minus the wax melting point may be greater than about −4° C. as mottle is poor at 4% wax because the temperature is not high enough compared to wax melting point. The coalescence temperature minus the wax melting point may be less than about 10° C. to prevent sticky particles.

In embodiments, the hybrid toners may have a very high circularity, such as about 0.990.

EA toners typically employ a C12C9 crystalline polyester (CPE, see Table 1) resin comprising dodecanedioic acid (C12) and nonanediol (C9), with a melting point of about 72.7° C. by differential scanning calorimetry (DSC). In the hybrid toners disclosed herein either C12C9 or C12C6, the latter comprised of dodecanedioic acid (C12) and hexanediol (C6), with a melting point 72.5° C., may be used. C12C6 is less costly than C12C9, but in some cases had been known to cause blocking issues. As indicated below excellent blocking can be achieved even with C12C6 in the hybrid toners disclosed herein.

TABLE 1

| CPE | Monomer repeat units | Peak melting $2^{nd}$ scan (° C.) | Mw | Mn | Acid Value (mg KOH/g) |
|---|---|---|---|---|---|
| C12C9 | C12 linear aliphatic acid, C9 linear aliphatic diol | 72.7 | 22.9 | 10.4 | 10.7 |
| C12C6 | C12 linear aliphatic acid, C6 linear aliphatic diol | 72.5 | 24.7 | 10 | 8.4 |

EA polyester toners commonly employ a polyethylene wax (A) with a peak of the melting curve in the second scan DSC of about 91.6° C. (see Table 2). The onset of melting of this wax is about 60° C. An example of an alternate wax effectively used in embodiments herein for the hybrid toner is a paraffin wax (B) with a lower mp of 77.3° C., but a similar onset of melting of about 60° C.

TABLE 2

| Wax | Wax chemical class | Onset of melting $2^{nd}$ scan (° C.) | Peak melting $2^{nd}$ scan (° C.) |
|---|---|---|---|
| A | Polyethylene wax | about 60 | 91.6 |
| B | Paraffin wax | about 60 | 77.3 |

EA polyester toners commonly employ NIPex® 35 a non-oxidized, low structure furnace black, while some other toners use REGAL® 330. To achieve a low dielectric loss it is beneficial to use a low conductivity carbon black such as the NIPex® 35. Because carbon black is a semi-conductor, it is further beneficial to keep the carbon black as pure as possible. Heteroatoms such as oxygen and sulfur dope the carbon black semi-conductor, increasing the conductivity. NIPex® 35 has very high carbon content on the surface as determined by XPS, >99.5%, and very low atom percent of oxygen and sulfur, less than about 0.5% total (see Table 3). Because the carbon black is very pure, and has very little of the very strong heteroatom dopants oxygen and sulfur on the surface, the conductivity is very low. This provides lower dielectric loss than with a less pure carbon black, such as Regal® 330, which has greater than about 1% oxygen and sulfur. The difference in the purity is most dramatically shown by the carbon:oxygen ratio of the carbon black, which is 499:1 for NIPex® 35, compared to 139:1 for Regal® 330.

TABLE 3

| Sample | Atom % C | Atom % O | Atom % S | Carbon: Oxygen Ratio |
|---|---|---|---|---|
| Regal ® 330 | 98.90 | 0.71 | 0.39 | 139:1 |
| NIPex ® 35 | 99.76 | 0.20 | 0.04 | 499:1 |

EA polyester toners commonly employ about 7.2 parts per hundred (pph) TaycaPower B2060 surfactant, a sodium salt of dodecylbenzene sulphonate as the dispersant for NIPex® carbon black dispersion in the toner.

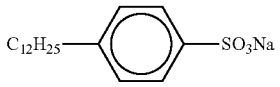

TaycaPower BN2060
Na Salt of DBS

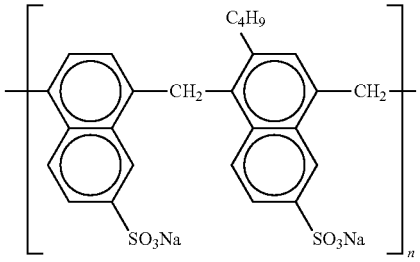

Demol SN-B

In embodiments, the amount of TaycaPower surfactant can be reduced in the pigment dispersion to only 2 pph, while adding 3.2 pph of DEMOL SN-B, which is a polymeric surfactant of butyl naphthalene sulfonicacid/2-naphthalene sulfonicacid/formaldehyde, sodium salt (Kao Corporation). The dispersion can then be used in making the hybrid toners herein having improved dielectric loss performance.

Similar products can be used to reduce dielectric loss. For example: DEMOL M, a sodium arylsulfonate formaldehyde condensate powder, DEMOL SS-L, a sodium arylsulfonate formaldehyde condensate, DEMOL N, DEMOL RN, DEMOL T and DEMOL T-45 sodium naphthalene sulfonate formaldehyde condensates powder, DEMOL NL a sodium naphthalene sulfonate formaldehyde condensates liquid. Other manufacturers provide similar sulphonate formaldehyde condensates such as 1-Naphthalenesulfonic acid, formaldehyde polymer, sodium salt CAS NO. 32844-36-3 available from Anyang Double Circle Auxiliary Co., LTD (China) and sodium naphthalene sulfonate formaldehyde CAS NO. 9084-06-4 available from Chemtrade International (China).

In embodiments, styrene-acrylate hybrid toners may be prepared with a styrene/acrylate shell latex containing low volatile organic compound (VOC) coalescent aids. Thus, in embodiments, there are provided processes of preparing a hybrid toner having a core and a shell, wherein the shell contains a non-volatile (i.e., a low VOC (volatile organic compound)) coalescent agent.

The process includes preparing a core mixture (or core latex) and heating the core mixture to form aggregated core particles; preparing a shell mixture (or shell latex), coating the shell mixture onto the aggregated core particles; heating the shell mixture and the aggregated core particles to coalesce the aggregated core particles to form toner particles; and isolating the toner particles.

Preparing the core particles includes mixing (1) a first latex comprising at least one styrene acrylate polymer resin, at least one amorphous polyester latex, and an optional crystalline polyester latex; (2) a wax, and (3) an optional colorant to form a core mixture; optionally adding a coagulant to the core mixture; heating the core mixture to a temperature below the glass transition temperature of any of the at least one styrene acrylate polymer resin to aggregate the core mixture to form aggregated core particles.

Preparing the toner shell includes mixing a second latex comprising at least one styrene acrylate polymer resin and a coalescent agent to form a shell mixture.

Lastly, the toner particles may be obtained by coating the shell mixture onto the aggregated core particles; heating the shell mixture and the aggregated core particles to a temperature below the glass transition temperature of any of the at least one styrene acrylate polymer resin to coalesce the aggregated core particles to form toner particles.

The toner may be prepared by emulsion aggregation (EA). In embodiments employing a low VOC coalescent agent, such agent may be incorporated into the toner shell during the emulsion polymerization stage. Emulsion polymerization is a technique used in forming polymers in which monomers are diffused into a micelle where free radical polymerization proceeds with the resulting formation of polymer particles. The coalescent agent may be mixed with a polymeric resin (i.e., a second latex) to form a shell mixture. The second latex may contain at least one styrene acrylate polymer resin. By incorporating the coalescence agent to the second latex not only ensures that the coalescence agent is homogeneously distributed within the shell mixture, but also localizes the coalescence agent in the thereby formed toner shell. The low VOC coalescence agent can diffuse into the shell mixture (or shell latex), and may be encapsulated within the shell latex. During the coalescence, some of the coalescent agent may further diffuse into the substrate, resulting in a hard robust toner coating.

The coalescent agent to be incorporated in the toner shell may have a high boiling point at atmospheric pressure of from about 250° C. to about 450° C., from about 250° C. to about 350° C., or from about 250° C. to about 400° C.

In embodiments, the coalescent agent may have a volatility of from about $10^{-8}$ to about $10^{-2}$ mm Hg, from about $10^{-8}$ to about $10^{-3}$ mm Hg, from about $10^{-8}$ to about $10^{-2}$ mm Hg at 20° C.

In embodiments, the coalescent agent may be insoluble in water. In embodiments, the coalescent agent may have a solubility in water of below about 0.5 weight percent, or from 0 to about 0.2 weight percent, or from 0 to about 0.15 weight percent at 20° C.

In embodiments, the coalescent agent may contain at least one ester linkage. In embodiments, the coalescent agent may be an organic compound containing from 8 to 20 carbon atoms, from 10 to 15 carbon atoms, or from 8 to 25 carbon atoms. The coalescent agent may include TEXANOL™ available from Eastman Chemical Company (2,2,4-trimethyl-1,3-pentanediol monoisobutyrate, or IUPAC: 3-hydroxy-2,2,4-trimethylpentyl 2-methylpropanoate), 2,2,4-trimethyl-1,3-pentanediol diisobutyrate, 2,2,4-Trimethyl-1,3-Pentanediol Monoisobutyrate, triethylene glycol di-2-ethylhexanoate, benzyl benzoate, diethylene glycol dibenzoate or IUPAC: 2-[2-(benzoyloxy)ethoxy]ethyl benzoate, 3-phenylpropyl benzoate, dipropylene glycol dibenzoate, propylene glycol dibenzoate or mixtures thereof.

Two or more coalescent agents may be mixed with the second latex. When two coalescent agents are used, the ratio of the two coalescent agents may be from about 1:5 to about 5:1, from about 1:3 to about 3:1, or from about 1:2 and to about 2:1. When three coalescent agents are used, the amount of the third coalescent agent may equal to or less than the amount of any of one of the first two coalescent agents.

Table 4 below lists exemplary coalescent agents suitable for use according to some embodiments.

TABLE 4

| Chemical Type | Boiling Point at Atmospheric Pressure (° C.) | Vapor Pressure (mm Hg at 20° C. |
|---|---|---|
| 2,2,4-trimethy1-1,3-pentanediol monoisobutyrate | 253 | $1 \times 10^{-2}$ |
| 2,2,4-trimethy1-1,3-pentanediol diisobutyrate | 285 | $<1 \times 10^{-2}$ |
| Triethylene glycol di-2-ethylhexanoate | 344 | $<1 \times 10^{-3}$ |
| Benzyl benzoate | 323 | $8 \times 10^{-3}$ |
| 3-Phenylpropyl benzoate | 343 | $5 \times 10^{-5}$ |
| Diethylene and dipropylene glycol dibenzoate (3:1) | >330 | $9 \times 10^{-5}$ |
| Propylene, dipropylene and Diethylene glycol dibenzoate (1:1:3) | >350 | $3.6 \times 10^{-6}$ |
| Diethylene and dipropylene glycol dibenzoate (3:2) | >350 | $1.0 \times 10^{-8}$ |

The amount of the coalescent agent used in mixing with the second latex to prepare the shell mixture is from about from about 0.1 to about 5.0 percent by weight, from about 0.5 to about 1.0 percent by weight, or from about 0.5 to about 2.0 percent by weight, based on the solid content in the shell mixture.

The majority of the coalescent agent (e.g., at least 95% by weight of the total weight of the coalescent agent used) does not evaporate during subsequent processing, such that the coalescent agent is present in the final prepared hybrid toner particles in an amount of from about 0.01 to about 2.0 percent by weight, from about 0.05 to about 0.3 percent by weight, or from about 0.1 to about 1.0 percent by weight, based on the final dry weight of the hybrid toner particles.

In embodiments, hybrid toners need not employ the VOC coagulating agent described hereinabove.

In embodiments, there are provided hybrid toners styrene-acrylate polyester with beta-carboxyethyl acrylate (also named as 3-(prop-2-enoyloxy)propanoic acid, or b-CEA or β-CEA) styrene-acrylate shell latex for improved particle formation and morphology. In an exemplary embodiment, 1.5 pph β-CEA styrene-acrylate latex may be used in hybrid toners with styrene-acrylate shells. Such toners may have a core and a shell, wherein the core comprises a first resin comprising a styrene acrylate copolymer, and an amorphous resin, and the shell comprises a second resin comprising in an amount of from about 0.05 pph to about 2.5 pph by weight of the shell. The second resin may also comprise a styrene acrylate copolymer.

Such toners may be prepared by emulsion aggregation (EA). The small amounts of β-CEA (i.e., from about 0.05 pph to about 2.5 pph) present in the shell is beneficial for the EA process helping to improve the resin flow in the toner coalescence. Without the presence of β-CEA in the shell may result in poor toner particle properties with respect to size, the geometric standard deviation (GSD), fines, and coarse. With more than 2.5 pph of β-CEA present in the shell may cause the coalescence process to be too slow for the shell latex resulting in poor toner particle properties, such as a rough and incomplete shell that does not encompass the entire toner particle.

In embodiments, the amount of β-CEA present in the second resin in the shell may be from about 1 pph to about 2 pph, from about 0.3 pph to about 1.7 pph, or from about 0.5 pph to about 1.5 pph by weight of the second resin.

In embodiments, the amount of β-CEA present in the first resin in the core may be from about 0 pph to about 10 pph of β-CEA by weight of the first resin, such as from about 3 pph to about 10 pph, from about 3 pph to about 8 pph, or from about 3 pph to about 5 pph by weight of the first resin. In one embodiment, no β-CEA is present in the first resin. The first resin may contain a lower amount of β-CEA, such as less than 3 pph by weight of the first resin, or having the same β-CEA content as in the second resin, or a higher β-CEA amount than that in the second resin. However, to avoid over spherodization of the core, it may not be desirable to improve the flow of the core latex in the core by lowering the amount of β-CEA present in the core. For example if the Tg and molecular weight of the first resin in the core is relatively low, lower β-CEA in the core may result in overspherodization of the core of the toner for embodiments where a non-spherical toner is desired. The term "spherodization" means that the overall toner particle circularity increases. It is desired that the circularity can be controlled, in embodiments within the range of about 0.93 and about 0.99. However, if the coalescence of the core is too rapid, then the circularity of the toner particle may not be easily controlled as it grows too rapidly. In a production scale, it is desirable that the target circularity of the toner particle to be reached within the time frame of from about 90 minutes to about 4 hours. If the coalescence process is faster than 90 minutes it may be difficult to monitor and stop the circularity increase. On the other hand, if the coalescence process is longer than 4 hours, then toner production throughput may suffer.

In embodiments, the amount of β-CEA in the first resin is higher than the amount of β-CEA in the second resin. In embodiments, the amount of β-CEA in the first resin is lower than the amount of β-CEA in the second resin.

The first and second resins may be the same or different. Illustrative examples of specific polymers for the first and second resins include, for example, poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly (alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), poly(styrene-1,3-diene), poly (styrene-1,3-diene-acrylic acid), poly(styrene-1,3-diene-acrylonitrile-acrylic acid), poly(styrene-butadiene), poly (methylstyrene-butadiene), poly (styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl methacrylate-acrylic acid), poly(butyl methacrylate-butyl acrylate), poly (butyl methacrylate-acrylic acid), poly(acrylonitrile-butyl acrylate-acrylic acid), and mixtures thereof. The alkyl group in the aforementioned polymers may be any alkyl group, and in particular may be a $C_1$-$C_{12}$ alkyl group, for example including methyl, ethyl, propyl and butyl. As the aryl group, any aryl group known in the art may be used.

In embodiments, the first resin and the second resin may be, independently, styrene-alkyl acrylate, more particularly a styrene-butyl acrylate polymer such as a styrene-butyl acrylate polymer.

In embodiments, the first resin and the second resin each include a styrene monomer and an acrylic monomer. In embodiments, the first resin further comprises at least one cross-linker. In embodiments, the second resin further comprises at least one cross-linker.

As used herein, the term "styrene monomer" refers to styrene per se, as well as styrene containing one or more substitutions, such as 3-chlorostyrene, 2,5-dichlorostyrene, 4-bromostyrene, 4-tert-butylstyrene, 4-methoxystyrene and the like.

As used herein, the term "acrylic acid monomer" refers to acrylic acid, methacrylic acid, and β-CEA. As used herein, the term "acrylic ester monomer" refers to esters of acrylic acid and methacrylic acid. Acrylic ester monomers include, but are not limited to, butyl acrylate, butyl methacrylate, propyl acrylate, propyl methacrylate, ethyl acrylate, ethyl methacrylate, methyl acrylate and methyl methacrylate. In certain embodiments, the acrylic ester monomer is n-butyl acrylate.

In embodiments, the styrene monomer is present in the core in an amount of from about 30 to about 90, or from about 70 to about 90 weight percent by weight of the core resin.

In embodiments, the acrylic ester monomer is present in the core in an amount of from about 10 to about 70, or from about 10 to about 30 weight percent by weight of the core resin.

In embodiments, the styrene monomer is present in the shell in an amount of from about 30 to about 90, or from about 70 to about 90 weight percent by weight of the shell.

In embodiments, the acrylic ester monomer is present in the shell in an amount of from about 10 to about 70, or from about 10 to about 30 weight percent by weight of the shell.

In embodiments, the first resin includes styrene and n-butyl acrylate.

In embodiments, the second resin includes styrene and n-butyl acrylate.

The first resin may have a mean particle size of from about 100 nm to about 250 nm, from about 100 nm to about 140 nm, from about 140 nm to about 200 nm, or from about 140 to about 250 nm.

The second resin may have a mean particle size of from about 100 nm to about 250 nm, from about 100 nm to about 140 nm, from about 140 nm to about 200 nm, or from about 140 to about 250 nm.

Amorphous Polyester Resin

The hybrid toner compositions may include core particles comprising an amorphous polyester resin. The amorphous polyester resin may be formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis (hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin. In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

(I)

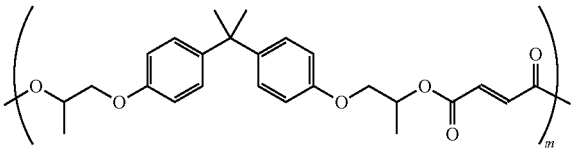

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

In embodiments, the resins utilized as the resin coating may have a glass transition temperature of from about 30° C. to about 80° C., in embodiments from about 35° C. to about 70° C. In further embodiments, the resins utilized as the resin coating may have a melt viscosity of from about 10 to about 1,000,000 Pa*S at about 130° C., in embodiments from about 20 to about 100,000 Pa*S.

Crystalline Polyester Resin

The crystalline resins, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly (propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isopthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium or potassium, and the like. In embodiments, the alkali metal is lithium.

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Optional Additives

The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin described above or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1 percent by weight of the toner, and in another embodiment at least about 0.25 percent by weight of the toner, and in one embodiment no more than about 5 percent by weight of the toner, and in another embodiment no more than about 3 percent by weight of the toner. Suitable additives include, but are not limited to, those disclosed in U.S. Pat. Nos. 3,590,000, 3,800,588, and 6,214,507, the disclosures of each of which are totally incorporated herein by reference. Again, these additives can be applied simultaneously with the shell resin described above or after application of the shell resin.

The toner particles of the present embodiments exhibits a dielectric loss of about 10 to about 45, from about 5 to about 35, or from about 5 to about 60. The toner particles of the present embodiments exhibits a gloss from about 10 ggu to about 60 ggu, from about 20 ggu to about 70 ggu, or from about 30 ggu to about 70 ggu on plain paper The toner particles of the present embodiments have an average particle size of from about 4 μm to about 10 μm, from about 4 μm to about 7 μm, or from about 4 μm to about 20 μm The toner particles of the present embodiments have an average circularity of from about 0.93 to about 0.99, from about 0.96 to about 0.98, or from about 0.95 to about 0.99. The toner particles of the present embodiments have a shape factor of from about 120 to about 140, from about 110 to about 130, or from about 105 to about 150. The toner particles of the present embodiments have a volume geometric standard deviation for (D84/D50) in the range of from about 1.15 to about 1.25, from about 1.15 to about 1.30, or from about 1.20 to about 1.25. The toner particles of the present embodiments have a number geometric standard deviation for (D16/D50) in the range of from about 1.15 to about 1.25, from about 1.15 to about 1.30, or from about 1.20 to about 1.25.

In embodiments, hybrid toners with a polyester shell (rather than a styrene-acrylate shell), with a relatively low overall styrene-acrylate content of 28% in the core, which makes loss less of an issue. Since the shell is polyester, coalescence can be reduced to as low as 70° C. and still provide a smooth shell. There was no issue with dielectric loss for this design.

In embodiments, the hybrid toner using both polyester and styrene-acrylate latex may employ about 20 to about 25 weight percent of an amorphous styrene-acrylate resin latex in the particle core thereby replacing some of the amorphous polyester with a lower cost styrene/acrylate latex. In some embodiments, the shell may be polyester, while in others it may be styrene-acrylate, and in still other embodiments it may be a mixture of polyester and styrene-acrylate.

In embodiments, hybrid toners with shells made of styrene/acrylate, polyester, or combinations thereof may be prepared by continuous coalescence.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Dielectric Loss Measurement

Dielectric loss of the parent toner particles, toner particles without external additives, was measured in a custom-made fixture connected to an HP4263B LCR Meter via shielded 1 meter BNC cables. To ensure reproducibility and consistency, one gram of toner (conditioned in J-zone 24 hours) was placed in a mold having a 2-inch diameter and pressed by a precision-ground plunger at about 2000 psi for 2 minutes. While maintaining contact with the plunger (which acted as one electrode), the pellet was then forced out of the mold onto a spring-loaded support, which kept the pellet under pressure and also acted as the counter-electrode. The current set-up eliminated the need for using additional contact materials (such as tin foils or grease) and also enabled the in-situ measurement of pellet thickness. Dielectric and dielectric loss were determined by measuring the capacitance (Cp) and the loss factor (D) at 100 KHz frequency and 1 VAC. The measurements were carried out under ambient conditions. The dielectric constant was calculated as:

$$E'=[\mathrm{Cp(pF)}\times\mathrm{Thickness(mm)}]/[8.854\times A\ \mathrm{effective(m^2)}]$$

Here 8.854 was just the vacuum electrical permittivity epsilon(o), but in units that take into account the fact that Cp was in picofarads, not farads, and thickness was in mm (not meters). A effective was the effective area of the sample. Dielectric loss=E*Dissipation factor, which was how much electrical dissipation there was in the sample (how leaky the capacitor was). This is multiplied by 1000 to simplify the values reported. Thus, a reported dielectric loss value of 70 indicates a dielectric loss of $70\times10^{-3}$, or 0.070.

Toner Additive Blending

For each sample, about 50 g of the toner were added to an SKM mill along with surface additives and then blended for about 30 seconds at approximately 12500 rpm. Surface additives were 1.29% RY50 L silica, 0.86% RX50 silica, 0.88% STT100H titania, 1.73% X24 sol-gel colloidal silica, and 0.18% zinc stearate, 0.5% PMMA and 0.28% cerium oxide particles.

Toner Charging Measurement

Toner charging was collected for the blended toner particle with surface additives. A mixture of 6 pph of toner in carrier was prepared by mixing 1.8 grams of toner and 30 grams of Xerox® 700 carrier in a 60 mL glass bottle. Samples were conditioned three days in a low-humidity zone (J zone) at 21.1° C. and 10% RH, and in a separate sample in a high humidity zone (A zone) at about 28° C./85% relative humidity. The developers with additive blended toner were charged in a Turbula mixer for 60 minutes. The toner charge was measured as the charge per mass ratio (Q/M) was also determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/M ratio.

Toner Blocking Measurement

Toner blocking was determined by measuring the toner cohesion at elevated temperature above room temperature for the toner blended with surface additives. Toner blocking measurement was completed as follows: two grams of additive blended toner was weighed into an open dish and conditioned in an environmental chamber at the specified elevated temperature and 50% relative humidity. After about 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom. The sieves were vibrated for about 90 seconds at about 1 mm amplitude with a Hosokawa flow tester. After the vibration was completed the sieves were reweighed and toner blocking is calculated from the total amount of toner remaining on both sieves as a percentage of the starting weight. Thus, for a 2 gram toner sample, if A is the weight of toner left the top 1000 μm screen and B is the weight of toner left the bottom 106 μm screen, the toner blocking percentage is calculated by: % blocking=50 (A+B)

Fusing Measurement

Fusing characteristics of the toners blended with additives were determined by crease area, minimum fixing temperature, gloss, document offset, and vinyl offset testing.

All unfused images were generated using a modified Xerox copier. A TMA (Toner Mass per unit Area) of 1.00 $mg/cm^2$ was used for the amount of toner placed onto CXS paper (Color Xpressions Select, 90 gsm, uncoated, P/N 3R11540) and used for gloss, crease and hot offset measurements. Gloss/crease targets were a square image placed in the centre of the page. Samples were then fused with an oil-less fusing fixture, consisting of a Xerox 700 production fuser CRU that was fitted with an external motor and temperature control along with paper transports. Process speed of the fuser was set to 220 mm/s (nip dwell of ~34 ms) and the fuser roll temperature was varied from cold offset to hot offset or up to 210° C. for gloss and crease measurements on the samples. After the set point temperature of the fuser roll has been changed, there is a wait time of ten minutes to allow the temperature of the belt and pressure assembly to stabilize.

Cold offset is the temperature at which toner sticks to the fuser, but is not yet fusing to the paper. Above the cold offset temperature the toner does not offset to the fuser until it reaches the Hot offset temperature.

Crease Area

The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard Teflon™ coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 millimeters correspond to about 1 mm in width. Further, the images exhibit fracture coefficients, for example of greater than unity.

From the image analysis of the creased area, it is possible to determine whether the image shows a small single crack line or is more brittle and easily cracked. A single crack line in the creased area provides a fracture coefficient of unity while a highly cracked crease exhibits a fracture coefficient of greater than unity. The greater the cracking, the greater the fracture coefficient.

Toners exhibiting acceptable mechanical properties, which are suitable for office documents, may be obtained by utilizing the aforementioned thermoplastic resins. However, there is also a need for digital xerographic applications for flexible packaging on various substrates. For flexible packaging applications, the toner materials must meet very demanding requirements such as being able to withstand the high temperature conditions to which they are exposed in the packaging process and enabling hot pressure-resistance of the images. Other applications, such as books and manuals, require that the image does not document offset onto the adjacent image. These additional requirements require alternate resin systems, for example that provide thermoset properties such that a crosslinked resin results after fusing or post-fusing on the toner image.

Minimum Fixing Temperature

The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Gloss

Print gloss (Gardner gloss units or "ggu") was measured using a 75 degree BYK Gardner gloss meter for toner images that had been fused at a fuser roll temperature range of about 120° C. to about 210° C. (sample gloss was dependent on the toner, the toner mass per unit area, the paper substrate, the fuser roll, and fuser roll temperature).

Gloss Mottle

The gloss mottle temperature is the temperature at which the print shows a mottled texture, characterized by non-uniform gloss on the mm scale on the print, and is due to the toner beginning to stick to the fuser in small areas.

Hot Offset

The hot offset temperature (HOT) is that temperature that toner that has contaminated the fuser roll is seen to transfer back onto paper. To observe it a blank piece of paper, a chase sheet, is sent through the fuser right after the print with the fused image. If an image offset is notice on the blank chase sheet at a certain fuser temperature then this is the hot offset temperature

Example 1

This example describes an exemplary toner with Regal 330 pigment dispersion and a control with NIPEX® 35.

A polyester toner was prepared at 1-L bench scale (Toner B) with the usual NIPEX® 35 carbon black replaced with 6% Regal 330. A similar control was prepared with NIPEX® 35 (Toner A). Both toner preparations also included 0.6% P15:3 cyan pigment. The Regal 330 pigment was a standard production dispersion of 140 nm size prepared with 7.1 pph TaycaPower B2060 (based on active surfactant to pigment on a dry weight basis). The dielectric loss was measured at 105 (note all dielectric loss values are multiplied by 1000× for convenience), compared to a control with NIPEX® 35 with a dielectric loss 27. Also the charge in both zones was much lower with Regal 330 than with NIPEX® 35. This experiment shows that a toner with a purified carbon black like NIPEX® 35 is beneficial for good dielectric loss. Because hybrid toners exhibit even higher dielectric loss as indicated herein, purified carbon black like NIPEX® 35 will also be beneficial for the hybrid toners. Thus, all subsequent hybrid toners were prepared with NIPEX® 35.

Current toners use a very pure carbon black pigment (NIPEX® 35) that provides relatively low conductivity, such that toner prepared under normal conditions of 85° C. coalescence provide good dielectric loss and good charge, as shown in Table 5 below. However, replacing the NIPex® 35 carbon black with a less pure carbon black, results in nearly a 2× increase in loss, and severe loss of charge. Thus, it is important to utilize a pure carbon black to enable low dielectric loss.

TABLE 5

| Toner ID | Pigment Composition | Dielectric Loss × 1000 | Q/M A-zone (μC/g) | Q/M J-zone (μC/g) |
|---|---|---|---|---|
| Toner A | 6% NIPex ® 35 + 0.6 P15:3 | 27 | 38 | 49 |
| Toner B | 6% Regal 330 + 0.6% P15:3 | 105 | 22 | 37 |

Example 2

NIPEX® Pigment Dispersions

In the hybrid toners, either a NIPEX® 35 pigment dispersion prepared with 7.2 pph TaycaPower (calculated based on % solids of dispersant to pigment, TaycaPower is 60% active ingredient solids/40% water) was used, or adispersion of NIPEX® 35 with a mixture of both 2 pph TaycaPowder and 3.2 pph Demol SN-B (all calculated based on wt % solids of dispersant to pigment, where TaycaPower is 60% active ingredient solids/40% water).

For the TaycaPower BN2060/Demol SN-B dispersion with 2 pph TaycaPower and 3.2 pph of Demol SN-B, a total of 1140 g of dispersion was prepared at a solids content of 20.83% in a Rannie 2000 homogenizer. The final particle size was 150 nm and was very stable with no settling overnight. The homogenizer run was 0.5 hours at low pressure of 2000 psi as a pre-homogenizing step and 3.5 hours at high pressure of 20,000 psi.

Example 3

Latex Preparation

Styrene, n-butylacrylate, β-CEA A 1-L scale latex emulsion, Latex A, comprised of polymer particles generated from the emulsion polymerization of 81.5% styrene, 18.5% n-butyl acrylate, 1.50 pph beta-carboxyethyl acrylate (β-CEA), and and 0.35 pph decanediol diacrylate (ADOD) was prepared as follows:

A surfactant solution of 1.17 grams Calfax® DB-45 (anionic emulsifier; sodium dodecyl diphenyl oxide disulfonate, 45 percent active, available from Pilot Chemical Company) and 306.6 grams deionized water was prepared by mixing for 10 minutes in a stainless steel holding tank. The holding tank was then purged with nitrogen for 5 minutes before transferring into the reactor. The reactor was then continuously purged with nitrogen while being stirred at 370 rpm. The reactor was then heated up to 80° C. at a controlled rate, and held there. Separately, 5.25 grams of ammonium persulfate initiator was dissolved in 48.9 grams of deionized water.

Separately, the monomer emulsion was prepared in the following manner. 285.41 g of styrene, 64.79 g of butyl acrylate, 5.25 g of β-CEA, 5.25 g of 1-dodecanethiol (DDT), 1.23 g of 1,10-decanediol diacrylate (ADOD), 6.61 g of Calfax® DB-45 (anionic surfactant), and 164.26 g of deionized water were mixed to form an emulsion. An aliquot of 5% of the above emulsion (26.64 g) was then slowly fed into the reactor containing the aqueous surfactant phase at 80° C. to form the "seeds" while being purged with nitrogen. The initiator solution was then slowly charged into the reactor over 20 minutes.

The remaining monomer emulsion was split into two aliquots; 253.08 g of the monomer emulsion was initially feed into the reactor at 1.93 g/min. The second aliquot of 253.08 g monomer emulsion was mixed with 3.50 g of DDT and added to the reactor at 2.70 g/min. Once all the monomer emulsion was charged into the main reactor, the temperature was held at 80° C. for 3 hours followed by an additional 4 hours at 85° C. to complete the reaction. Full cooling was then applied and the reactor temperature was reduced to 25° C. The product was collected into a holding tank and sieved with a 25 μm screen.

The particle size was then measured by Nanotrac® U2275E particle size analyzer. Narrow particle size was achieved with a particle Size=182 nm±70 nm.

The latex had a second onset $T_g$=52.5 by DSC, and a $M_w$=25.6 kilodaltons, $M_n$=6.7 kilodaltons measured using a Waters® ACQUITY® Advanced Polymer Chromatography™ (APC™) System based on polystyrene standards.

A 100-gal latex emulsion, latex B, comprised of polymer particles generated from the emulsion polymerization of 81 wt % styrene, 19 wt % n-butyl acrylate, 1.5 pph beta-carboxyethyl acrylate (β-CEA) and and 0.35 pph ADOD was prepared as follows:

Calfax Surfactant Solution Preparation: A surfactant solution of 0.334 kilograms Calfax® DB-45 (anionic emulsifier; sodium dodecyl diphenyl oxide disulfonate, 45 percent active, available from Pilot Chemical Company) and 87.23 kilograms deionized water was charged into a stainless steel 100-gal capacity reactor and mixed at 110 rpm. The reactor was equipped with a condenser and purged with nitrogen at 10 Standard Cubic Feet per Hour (SCFH VAPOR) while being heated up to 75° C. at a controlled rate and held there.

Emulsified Monomer Preparation: Separately in 45 gal plastic drum, 1.89 kilograms Calfax® DB-45 and 46.73 kilograms deionized water were mixed together as the surfactant solution. Separately in a 50-gal capacity reactor, the monomer emulsion was prepared as followed: 81.1 kg of styrene, 19.02 kg of butyl acrylate, 1.05 kg of β-CEA, 1.37 kg of 1-dodecanethiol (DDT) and 0.350 kg of 1,10-decanediol diacrylate (ADOD). The surfactant solution was then transferred to the 50-gal capacity reactor containing the monomer emulsion by vacuum while being stirred at 150 rpm. The surfactant solution and monomer emulsion were mixed for 5 minutes followed by no mixing for 3 minutes; this "mix/sit" step was repeated two times to create an emulsified aqueous monomer solution.

Separately in a 5-gallon pail, 1.50 kilograms of ammonium persulfate initiator was dissolved in 13.91 kilograms of deionized water.

Into the 100-gal reactor containing the heated Calfax surfactant solution was added 7.60 kg (5% seed) of the emulsified monomer to form the "seeds". After 20 minutes, the initiator solution addition was started and charged into the reactor over 23.5 minutes. This was chased with 1.0 kg of deionized water.

Monomer Feed Reaction: After 20 minutes, the remaining monomer emulsion was added into the 100-gal reactor over two aliquots. Feed #1 was added into reactor over 120 minutes and equated to 72.2 kg of emulsified monomer followed by 1.2 kg of deionized water "chase". To the remaining monomer emulsion (feed #2) was added 0.63 kg 1-dodecanethiol (DDT) and fed into the reactor over 90 minutes. At this point the rpm was increased to 120 and an extra 2.3 kg of deionized water "chase" was added to reactor to clear emulsified monomer from pump lines. The reactor was held at 75° C. for 60 minutes. The condenser was turned off after 1 hour post reaction while still at 75° C. and excess monomer was allowed to blow out of reactor for 120 minutes before cooling to room temperature. The white non-viscous liquid was then discharged into two closed head plastic drums once the temperature plateaued to room temperature.

The particle size was then measured by Nanotrac® U2275E particle size analyzer. Narrow particle size was achieved with a Particle Size=188 nm±60 nm. The second onset Tg=55.3° C. by DSC, and the latex Mw=24.5 kilodaltons and Mn=8.97 kilodaltons measured with a Waters® ACQUITY® Advanced Polymer Chromatography™ (APC™) System and using polystyrene standards.

Example 4

Hybrid Toner Preparation and Evaluation

Preparation of Hybrid Toner

To the 2 L glass reactor was added 103.68 g of amorphous polyester emulsion A, 103.68 g of amorphous polyester emulsion B, 21.76 g of styrene-acrylate latex emulsion C, 28.35 g of crystalline polyester emulsion D, 20.16 g of paraffin wax (N539), 9.55 g of cyan pigment (PB15:3), 44.33 g of black pigment (Nipex-35) and 533.57 g of DI water. Subsequently, 2.70 g of PAC (poly-aluminum chloride) was mixed with 33.30 g of 0.02M nitric acid, and then added to the slurry under homogenization at 3000-4000 RPM, and the pH was adjusted from 7.0 to 3.0 with 0.3M nitric acid. The reactor was set to 250 RPM and was heated to 44° C. to aggregate the toner particles. When the particle size reached about 5.8 microns, a shell coating of 113.50 g styrene-acrylate latex emulsion C was added to the reactor and the stirring speed was reduced to 215 RPM. When the toner particle size reached about 6 microns, the stirring speed was lowered further to 180 RPM and particle freezing was initiated by pH adjusting the slurry with 10.48 grams of a chelating agent (Versene100) until pH reached 6.62. About 5 g of 1M NaOH was added to slurry to further increase the pH to 7.70. The reactor temperature was then ramped to 70° C. Once at 70° C., the RPM was reduced to 150 and the pH of the slurry was reduced from 7.28 to 4.00 with 63.32 g of 0.3M nitric acid. The reactor temperature was further ramped to 80° C. Once at the coalescence temperature, the slurry was coalesced for 90 minutes until the particle circularity was between 0.970-0.980 as measured by the Flow Particle Image Analysis (FPIA) instrument. The slurry was then quench cooled in 623 g DI ice to a temperature of about 25° C. The final particle size was 5.90 microns, GSDv 1.21, GSDn 1.25 and a circularity of 0.977. The toner was then washed and freeze-dried.

As shown in Table 6 below hybrid black toners were prepared with different formulations of wax, pigment dispersant and process conditions, in particular the coalescence temperature. Two styrene/acrylate latexes of differing $T_g$, but nearly the same $M_w$ and $M_n$ were also used, as described above. All toners were comprised of four resins, an amorphous polyester resin in an emulsion (polyester emulsion A), having an average molecular weight (Mw) of about 86,000, a number average molecular weight (Mn) of about 5,600, an onset glass transition temperature ($T_g$ onset) of about 56° C., and about 35% solids; an amorphous polyester resin in an emulsion (polyester emulsion B) having an Mw of about 19,400, an Mn of about 5,000, a Tg onset of about 60° C., and about 35% solids in a 1:1 ratio; a with 6.8 wt % of the toner as a crystalline polyester resin (CPE C12:C6) in an emulsion, having an Mw of about 23,300, an Mn of about 10,500, a melting temperature ($T_m$) of about 71° C. and about 35.4% solids; and either 10% or 30% of one of the styrene/acrylate latexes of Example 3 in the core with respect to the total amorphous resin content in the core. The shell in all cases was also the styrene/acrylate latex, in each case the same one as in the core. For toners with 30% styrene/acrylate in the core, Examples 5 and 6, the amount of shell was 12.5% with respect to the total amount of toner. For the other examples in Table 6 the toners has 10% of the styrene-acrylate latex in the core, and 28% in the shell with respect to the total amount of toner. Thus in all cases the total styrene/acrylate resin was 39% of the total polyester resin in the toner.

In all cases the toners also contained a wax in toner core at 4 wt % of the toner, and 6 wt % of NIPex 35 carbon black pigment, 1 wt % of cyan PB15:3 pigment, and either apolyethylene wax or a paraffin wax as described in Table 2. The cyan pigment dispersant was Tayca, and the carbon black pigment dispersant was either standard Tayca, or the combination of Tayca and Demol SN-B described above.

Table 6 below shows some key toner properties and results of evaluation of toners prepared from the polyethylene wax, which has a wax melting point of 91.6° C., and thus where the wax peak melting point is about 19° C. above the peak melting point of the CPE, and toners prepared with the paraffin wax, which has a wax melting point of 77.3° C., and thus where the wax peak melting point is about 5° C. higher compared to the CPE peak melting point. Comparing the performance of the four toners prepared with the same styrene-acrylate latex, two with the higher melt wax, Hybrid Toner Examples 1 and 2, and two with the lower melt wax, Examples 5 and 6, the toners have similar cold offset temperature (COT) on the fuser, similar temperature to reach a minimum gloss of 40, a similar crease minimum fusing temperature (MFT), but show that the lower melt wax provides a higher and better fuser mottle temperature and hot offset temperature (HOT), as well as a better higher blocking temperature. The higher melt wax is thus unable to melt sufficiently during the fusing process of the hybrid toner, as the fuser temperature is set to fuse the toner at a temperature where the CPE melts and provides effective low melt properties, shown by the low minimum gloss temperature and the low MFT for both waxes, but this temperature is insufficient to release sufficiently the high melt wax to the fuser, and thus the mottle and HOT are too low, resulting in poor fusing latitude at high temperatures. Only with the low melt wax, with the melting point close enough to the CPE melt point, is it possible to provide the best fusing latitude with high peak gloss and high mottle and HOT temperature, and thus wider fusing latitude. Also, the blocking temperature is higher with the lower melt wax, which may be due to a better morphology in the toner as the higher melt wax may not melt sufficiently in the toner process, as the coalescence temperature is lower at 80 to 85° C. in these toners than the peak melting point of the wax, while with the lower melt wax even at 75° C. coalescence, as in Example 6, the wax apparently is able to melt sufficiently in the process to provide a better blocking.

Also shown in Table 6 are dielectric loss evaluation of the toners. In Hybrid Toner Example 1, with the higher melt wax and the high coalescence temperature of 85° C. the dielectric loss is very high, because there is too much flow of the polyester resin core with the plasticization from the melted CPE in the toner coalescence process, which results in migration and aggregation of the conductive carbon black particles in the toner. Reducing the coalescence temperature to 80° C. with the higher melt wax, Hybrid Toner Example 2, much improves the dielectric loss, but the loss is still higher than the desired ≤65. While even a lower coalescence temperature would further reduce loss, it is not possible to prepare good toner with the high melt wax at temperatures lower than 80° C. With the low melt wax at 80° C. the loss is also too high in Hybrid Toner Example 5, but it is possible to make good toner at 75° C. coalescence with the lower melt wax, with acceptable low dielectric loss 65° C., as shown in Hybrid Toner Example 6.

Also shown in Table 6 are two toner examples made with the low and high melt waxes, Hybrid Toner Example 3 and 4, respectively, under identical toner process conditions with 80° C. coalescence temperature, but using a mixed dispersant of SN-B and Tayca for the carbon black. The St-Ac latex Tg was lower than that used for the other toners listed in the table. As with the other toners in Table 6, the lower melt wax in Hybrid Toner Example 4 provided higher, better peak gloss, higher mottle temperature, and better blocking than with the higher melt wax in Hybrid Toner Example 3. But due the use of the mixed dispersant of SN-B and Tayca the dielectric loss is improved compared to the other examples in the table that used Tayca alone. So dielectric loss with this mixed dispersant is good with both low and high melt point waxes at the higher coalescence temperature.

Thus, by utilizing a lower melt-point wax, close to the desired lower coalescence temperature, and where the wax melting point is not too high compared to the CPE melting point, the fusing latitude to mottle and hot offset, and the blocking are improved. Also the lower melt wax, closer to the melting of the CPE, allows a lower coalescence temperature in the toner process providing particles with lower acceptable dielectric loss. Addition of SN-B dispersant with the Tayca dispersant to disperse the carbon black provides a lower and acceptable dielectric loss with both low and high melt waxes even at the higher 80° C. coalescence temperature.

TABLE 6

| Property | Hybrid Toner Sample 1 | Hybrid Toner Sample 2 | Hybrid Toner Sample 3 | Hybrid Toner Sample 4 | Hybrid Toner Sample 5 | Hybrid Toner Sample 6 |
|---|---|---|---|---|---|---|
| Size/GSDv/n | 6.5/1.21/1.20 | 6.3/1.22/1.21 | 6.6/1.22/1.44 | 5.9/1.21/1.25 | 6.1/1.21/1.25 | 6.1/1.21/1.29 |
| Circularity | 0.970 | 0.987 | 0.977 | 0.977 | 0.991 | 0.991 |
| CPE | | | C12:C6 | | | |

TABLE 6-continued

| Property | Hybrid Toner Sample 1 | Hybrid Toner Sample 2 | Hybrid Toner Sample 3 | Hybrid Toner Sample 4 | Hybrid Toner Sample 5 | Hybrid Toner Sample 6 |
|---|---|---|---|---|---|---|
| Wax | 4% polyethylene | | | 4% paraffin | | |
| Wax mp | 91.6 | 91.6 | 91.6 | 77.3 | 77.3 | 77.3 |
| CB Dispersant | Tayca | | SN-B/Tayca | | Tayca | |
| Coal. T (° C.) | 85 | 80 | 80 | 80 | 80 | 75 |
| Coal. T - Wax mp | −6.6 | −11.6 | −11.6 | 2.7 | 2.7 | −2.3 |
| Coal. T - CPE mp | 12.5 | 7.5 | 7.5 | 7.5 | 7.5 | 2.5 |
| Wax mp - CPE mp | 19.1 | 19.1 | 19.1 | 4.8 | 4.8 | 4.8 |
| ICP Al | 183.2 | 333 | 117 | 139 | 244 | 244 |
| St-Ac Latex Tg | 55.3 | 55.3 | 52.5 | 52.5 | 55.3 | 55.3 |
| St-Ac Latex Mw | 24.3 | 24.3 | 25.6 | 25.6 | 24.3 | 24.3 |
| COT | 123 | 127 | 123 | 120 | 127 | 123 |
| Peak Gloss | 54 | 56 | 61 | 67 | 62.9 | 62.2 |
| T (Gloss 40) | 134 | 131 | 130 | 127 | 136 | 134 |
| $MFT_{C4-80}$ | 131 | 129 | 128 | 126 | 131 | 131 |
| Mottle (° C.) | 165 | 150 | 160 | 175 | 185 | 185 |
| HOT (° C.) | 175 | 180 | 175 | 175 | 185 | 185 |
| Blocking | no data | 54.2 | 53.0 | 54.0 | 55.0 | 55.3 |
| Loss | 170 | 70.0 | 52.0 | 47.0 | 75.0 | 51.0 |

The difference in the melting point of the wax and the CPE in the table is the difference as measured in the separate pure materials as measured in the $2^{nd}$ heating scan differential scanning calorimetry (DSC) of the pure wax and the pure CPE resin. The difference in melting points is detectable in the toner as two separate peaks in the first heating scan of the modulated differential scanning calorimetry (MDSC) reversible heat flow. Thus, for example, for the Hybrid Toner Example 3 the CPE endothermic peak melting is at 66.1° C., the wax endothermic peak melting at 90° C., with a difference in the peak melting temperature for the wax minus peak melting temperature for the CPE of 23.9° C. For the Hybrid Toner Example 4 the CPE peak melting temperature is 66.0° C., the wax peak melting temperature is 75.3° C., with a difference in the peak melting temperature for the wax minus the peak melting temperature for the CPE of 9.3° C.

What is claimed is:

1. A hybrid toner comprising:

a core comprising at least one amorphous polyester resin and at least one crystalline polyester resin, and at least one styrene/acrylate resin;

a shell comprising at least one styrene/acrylate resin;

at least one wax; and a pigment dispersion comprising a pigment and a dispersant;

wherein the first modulated differential calorimetry scan of the hybrid toner shows at least two melting point peaks below about 80° C., and wherein the difference between the two melting point peaks is less than or equal to about 15° C.; wherein the pigment dispersion comprises a carbon black, a sodium dodecyl benzene sulfonate and a sulphonate formaldehyde condensate, and wherein the toner exhibits a dielectric loss less than about 65.

2. The hybrid toner of claim 1, wherein the toner further comprises a polymeric sulfonate surfactant.

3. The hybrid toner of claim 1, wherein the wax is a paraffin wax and is in the core, the shell, or both, the wax having a peak melting point less than about 80° C., and an onset of melting greater than or equal to about 50° C.

4. The hybrid toner of claim 1, where the wax is a polyethylene or polymethylene wax and is in the core, the shell, or both, the wax having a peak melting point less than about 80° C., and an onset of melting greater than or equal to about 50° C.

5. The hybrid toner of claim 1, wherein the crystalline polyester has a melting point less than or equal to about 80° C. and an onset of melting greater than or equal to about 50° C.

6. The hybrid toner of claim 1, wherein the difference between the wax melting point and the crystalline polyester is less than or equal to about 15° C.

7. The hybrid toner of claim 1, wherein the styrene acrylate resin has an onset $T_g$ in the second heat DSC scan from about 50° C. to about 56° C.

8. The hybrid toner of claim 1, wherein the crystalline polyester comprises a C12 diacid and a C6 diol.

9. The hybrid toner of claim 1, wherein the polyester comprises a C12 diacid and a C9 diol.

10. The hybrid toner of claim 1, wherein the carbon black pigment has a carbon content of greater than or equal to about 99.5 atom percent.

11. A hybrid toner comprising:

a core comprising a crystalline polyester resin, an amorphous polyester resin and a styrene/acrylate resin;

a shell comprising a styrene/acrylate resin;

a wax disposed within the shell, the core or both; and a pigment dispersion comprising a pigment and a dispersant, wherein the pigment dispersion comprises a sodium dodecyl benzene sulfonate and a sulphonate formaldehyde condensate;

wherein the difference between the wax melting point and the crystalline polyester melting point is less than or equal to about 15° C., and further wherein the toner exhibits a dielectric loss less than about 65.

12. The hybrid toner of claim 11, wherein the toner further comprises a polymeric sulfonate surfactant.

13. The hybrid toner of claim 11, wherein the wax is in the core, the shell, or both, the wax having a peak melting point less than about 80° C.

14. The hybrid toner of claim 11, wherein the wax has an onset of melting greater than or equal to about 50° C.

15. The hybrid toner of claim 11, wherein the crystalline polyester has a melting point less than or equal to about 80° C.

16. The hybrid toner of claim 11, wherein the styrene acrylate resin has a second onset $T_g$ from about 50° C. to about 56° C.

17. The hybrid toner of claim 11, wherein the polyester comprises a C12 diacid condensed with a C6 or C9 diol.

18. The hybrid toner of claim 11, wherein the pigment dispersion comprises a carbon black pigment in a non-polymeric sulfonate surfactant, wherein a purity of the carbon black pigment is greater than about 99.5 atom percent carbon.

19. A hybrid toner comprising:

a core comprising a crystalline polyester resin, an amorphous polyester resin and a styrene/acrylate resin;

a shell comprising a styrene/acrylate resin;

a paraffin wax disposed within the shell, the core or both; and a dispersion of a carbon black pigment in a non-polymeric sulfonate surfactant, wherein a purity of the carbon black pigment is greater than about 99.5 atom percent carbon, wherein the dispersion comprises a sodium dodecyl benzene sulfonate and a sulphonate formaldehyde condensate;

wherein the paraffin wax is in the core, the shell, or both, the wax having a peak melting point less than about 80° C.;

wherein the paraffin wax has an onset of melting greater than or equal to about 50° C.;

wherein the crystalline polyester has a melting point less than or equal to about 80° C.;

wherein the difference between the paraffin wax melting point and the crystalline polyester is less than or equal to about 15° C.;

wherein the styrene acrylate resin has a second onset $T_g$ from about 50° C. to about 56° C.; and wherein the toner exhibits a dielectric loss less than about 65.

* * * * *